US005241769A

United States Patent [19]

Von Muller

[11] Patent Number: 5,241,769

[45] Date of Patent: Sep. 7, 1993

[54] SAFETY LOCKING DEVICES FOR TUBULAR MAGAZINE FIREARMS

[76] Inventor: Francis Von Muller, 153 State St., Brooklyn, N.Y. 11201

[21] Appl. No.: 931,060

[22] Filed: Aug. 17, 1992

[51] Int. Cl.[5] ..... F41A 17/56

[52] U.S. Cl. ..... 42/70.11; 42/70.04; 42/70.08

[58] Field of Search ..... 42/70.11, 70.01, 70.04, 42/70.05, 70.08; 89/149, 154, 148, 153

[56] References Cited

U.S. PATENT DOCUMENTS

| | | | |
|---|---|---|---|
| 75,248 | 3/1868 | Crabtree et al. | 42/70.08 |
| 978,144 | 12/1910 | Dunham | 42/70.08 |
| 3,018,576 | 1/1962 | Riechers | 42/70.11 |
| 3,089,972 | 5/1963 | McKinlay | 42/70.11 |
| 3,605,311 | 9/1971 | Hermann | 42/70.11 |
| 3,634,963 | 1/1972 | Hermann | 42/70.11 |
| 4,058,923 | 11/1977 | Smith | 42/17 |
| 4,352,317 | 10/1982 | Wilhelm | 89/154 |
| 4,532,729 | 8/1985 | Von Muller | 42/70.11 |
| 4,654,992 | 4/1987 | Lavergne | 42/70.01 |
| 4,995,180 | 2/1991 | Tucker et al. | 42/70.11 |

FOREIGN PATENT DOCUMENTS

| | | | |
|---|---|---|---|
| 552771 | 2/1958 | Canada | 42/70.01 |
| 2908066 | 9/1979 | Fed. Rep. of Germany | 42/70.11 |
| 2920679 | 11/1979 | Fed. Rep. of Germany | 42/70.11 |

*Primary Examiner*—Stephen M. Johnson
*Attorney, Agent, or Firm*—Robert W. J. Usher

[57] ABSTRACT

A key operated safety locking device of a tubular magazine firearm has comprising a body insertable through a loading port thereof so as to be contained substantially completely within the tubular magazine forming a snug fit with a rim of the loading port and containing a key operated latching member engaging behind the rim of the loading port; an action bar engaging projection extending rearwardly from the body into engagement with an action bar lock of the firearm to pivot the action bar, raising a connector out of alignment with a sear into an inoperative position so that squeezing the trigger cannot effect release of the hammer and the firearm will not fire. In an alternative, a hammer blocking member is carried by the body and maintains the hammer spaced apart from the firing pin.

7 Claims, 4 Drawing Sheets

SAFETY LOCKING DEVICES FOR TUBULAR MAGAZINE FIREARMS

FIELD OF THE INVENTION

The present invention relates to tubular magazine firearms and, in particular to safety locking devices that can be locked into the loading port of tubular magazine firearms such as a shot gun thereby rendering the weapons incapable of being loaded or fired.

BACKGROUND OF THE INVENTION

As evidenced by the following examples, there have been numerous prior attempts over many years to provide externally applied safety devices for firearms.

U.S. Pat. No. 3,018,576 to Riechers discloses a block form locking device that clamps over the side ejection port of a tubular magazine shot gun. The device is substantially entirely external of the firearm, does not inhibit loading or unloading of the magazine and employs rubber gasketing on external contact surfaces making the unit vulnerable to unauthorized removal by a prying action.

U.S. Pat. No. 3,605,311 to Hermann discloses a locking device for tubular magazine firearms that is inserted in and fully occupies, the breech area behind the chamber of the barrel. The device does not restrict access to the magazine, is not readily adaptable to bottom ejection port type firearms and locks the gun in the open position, thus adversely affecting the utility for sales display or handling demonstrations.

U.S. Pat. No. 4,058,923 to Smith discloses a snap fitting type of clip for a tubular magazine shot gun which is largely exterior of the firearm. There is no disclosure or suggestion of a locking feature.

U.S. Pat. No. 4,654,992, to Lavergne discloses an exterior locking device for tubular magazine firearms that provides a bar extending across the bottom loading port and a tab projecting into the side ejection port that restricts movement of the breech block to the rear two thirds of its normal travel. The employment of this device makes the finish of the firearm vulnerable to damage caused by forceful closing of the breechblock, while the device is not readily adaptable to bottom ejection port type firearms and may be prone to unauthorized removal by prying.

SUMMARY OF THE INVENTION

An object of this invention is to provide a compact, key operated safety locking device for tubular magazine firearms that can easily be installed and removed from the magazine via the loading port, in the breech closed state, that locks the mechanism of the firearm thereby giving the owner of the weapon complete control over the loading and firing at all times.

Another object of the invention is to provide a safety locking device of a tubular feed firearm that, when installed in the firearm, interacts with the firing mechanism preventing firing of the weapon even if loaded at the time of installation of the safety locking device.

A further object of the invention is to provide a safety locking device for a tubular magazine firearm that fits entirely within the outer profile of the firearm so as not to affect the appearance for purposes of exhibition, sales display, or handling demonstration and furthermore, inhibits or discourages unauthorized attempts at forcible removal.

An associated object is to maintaining the original, smooth profile of the gun avoiding projections which could catch on hands or clothing of the user when handling or casing the gun.

An additional objective of the invention is to provide a safety locking device for a tubular magazine firearm that could be utilized by police or military organizations handling loaded guns but would secure those guns if left temporarily unattended and, furthermore, to enable safe storing for the firearms, fully loaded for incident use.

Another object of the invention is to provide a safety locking device for a tubular magazine firearm that temporarily disables the weapon to meet all legal restrictions imposed on the possession, transportation or storage of firearms in certain localities.

Another object of the invention is to provide a safety locking device for a tubular magazine firearm that can be used in the firearm without requiring any accommodating alterations or adaptations.

Another object of the invention is to provide a safety locking device for a tubular magazine firearm that can be utilized therein without imposing danger to the bluing, plating or other finish of the firearm.

An additional object of the invention is to provide a safety locking device for a tubular magazine firearm that is of simple, rugged design, suitable for mass production using modern or traditional materials and capable of production at low cost.

A further object of the invention is to provide a safety locking device for a tubular magazine firearm that could economically be supplied by gun manufacturers with each new gun sold and thereby, possibly, result in a reduction in the rate of firearm injury and fatality from accidents, acts of violence or suicide.

According to one aspect of the invention, in a tubular magazine firearm of the type comprising a trigger linked to a hammer restraining sear by a connector pivotally mounted for movement by the trigger along a path into operative engagement with the sear, causing the sear to release the hammer, and a rocking action bar having a rocking arm extending away from a loading port into engagement with the side of the connector and pivotal in one direction to carry the connector out of the operational path of engagement with the sear to prevent release of the hammer key operated safety locking device there is provided a key operated safety locking device comprising:

a body insertable through the loading port so as to be contained substantially completely within the tubular magazine and forming a snug fit with a rim of the loading port;

a key operated locking mechanism contained in the body;

latching means mounted for movement in the body by the locking mechanism between advanced, latching and retracted unlatching positions, engaging behind the rim of the locking port and withdrawn within the profile of the body, respectively;

an action bar engaging projection extending rearwardly from the body and engageable by receipt of the body in the loading port, with the action bar lock to pivot the action bar in the one direction raising the connector into an inoperative position so that squeezing the trigger cannot effect release of the hammer and the firearm will not fire.

Preferably, the firearm includes a shell carrier moveable from a lower loading port covering position to a raised position, spaced above the loading port and the base of the receiver leaving a gap therebetween and the tail piece is received between the shell carrier and the receiver base and further comprising ejection means comprising a button mounted on a top of the body and depressible into a well formed in the body against the action of a biasing spring, insertion of the body into the loading port moving the shell carrier to the raised position with engagement of the button with the shell carrier depressing the button into the body by engagement with the shell carrier so that, on release of the latching mechanism, the restoring force of the biasing spring advances the button from the well, ejecting the safety locking device from the loading port.

The ejection means enables the body to be inserted and removed from the loading port very easily, by hand, without the need for additional prying tools even though the cover plate is substantially flush with the wall of the receiver.

This is an important practical advantage as the ease of use will encourage regular use of the safety locking device.

Desirably, there are spring means within the body biasing the latching means into the advanced latching position, a camming nose formed on the latching means engageable with a forward rim of the loading port on insertion of the body tail first therein, for camming the latch into the body against the action of the biasing spring, whereby the body is receivable, rear end leading, into the loading port with a snap action.

An important advantage is that the gun cannot be fired as soon as the body is inserted into the loading port irrespective of the condition of the locking mechanism.

Preferably, the body includes a block having a cavity therein and a cover plate attachable to the body to close the cavity, trapping the locking means and ejection means therein and the cover plate includes a portion of channel section received on the block as a sliding fit.

The locking safety device employs few parts and is easy to assemble.

In one arrangement, interior, opposite walls of the receiver are formed with longitudinally extending grooves and the latching means comprises a pair of latching lands carried by respective cantilever spring arms, the body being formed with a slot and the cantilever spring arms being mounted in the slot biasing the lands towards each other so as to be contained entirely within the block, in an unlocked condition and an operating member having a tapered, camming nose located between the lands and operably connected to the lock mechanism for movement between advanced, locking and retracted, release positions, camming the respective lands apart into the grooves and permitting the respective lands to resile back into the body, respectively.

This provides extremely secure mounting for the device which cannot be removed without operation of the key even by disassembly of the firearm.

According to another aspect of the invention, in a tubular magazine firearm of the type having a loading port, and a hammer pivotally mounted for firing movement towards the loading port, a trigger integrally joined to a hammer engaging sear so that pulling the trigger disengages the sear from restraining engagement with the hammer to release the hammer, there is provided a key operated safety locking device comprising a body insertable through the loading port so as to be contained substantially completely within the tubular magazine and forming a snug fit with a rim of the loading port; a key operated locking mechanism contained in the body; latching means mounted for movement in the body by the locking mechanism between advanced, latching, and retracted, unlatching positions, engaging behind the rim of the locking port and withdrawn within the profile of the body, respectively; and, blocking means mounted on the rear of the body for engagement with the hammer maintaining the hammer spaced from the firing pin. Preferably, the hammer blocking means includes an upstanding projection for engagement behind the slide, thereby locking the slide and the breechblock in place, preventing opening movement of the breech.

This very simple mechanism blocks the hammer as soon as inserted into the loading port, engaging an uncocked hammer to move it away from the firing pin.

BRIEF DESCRIPTION OF THE DRAWINGS

Specific embodiments of the invention will now be described by way of example only and with reference to the accompanying drawings in which:

FIG. 1(*d*) is a plan view of a suitable key for the locking device;

FIG. 7(*d*) is a plan view of a suitable key for the third embodiment; and,

DETAILED DESCRIPTION OF EMBODIMENTS OF THE INVENTION

Figure 1A:
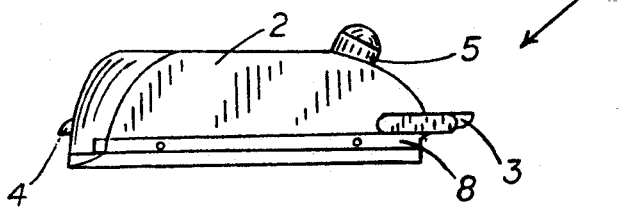
FIGS. 1(*a*)–1(*c*) are, respectively, side elevational, rear elevational and underplan views of a first embodiment of locking device.
Figure 1B:
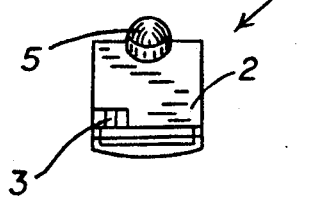
Figure 1C:
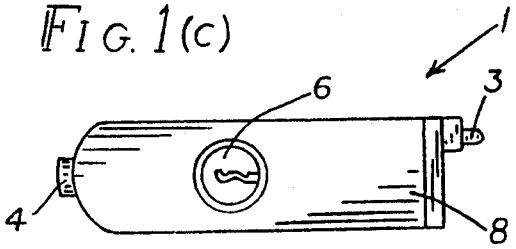
Figure 1D:
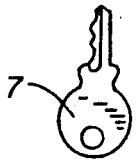
Figure 2:
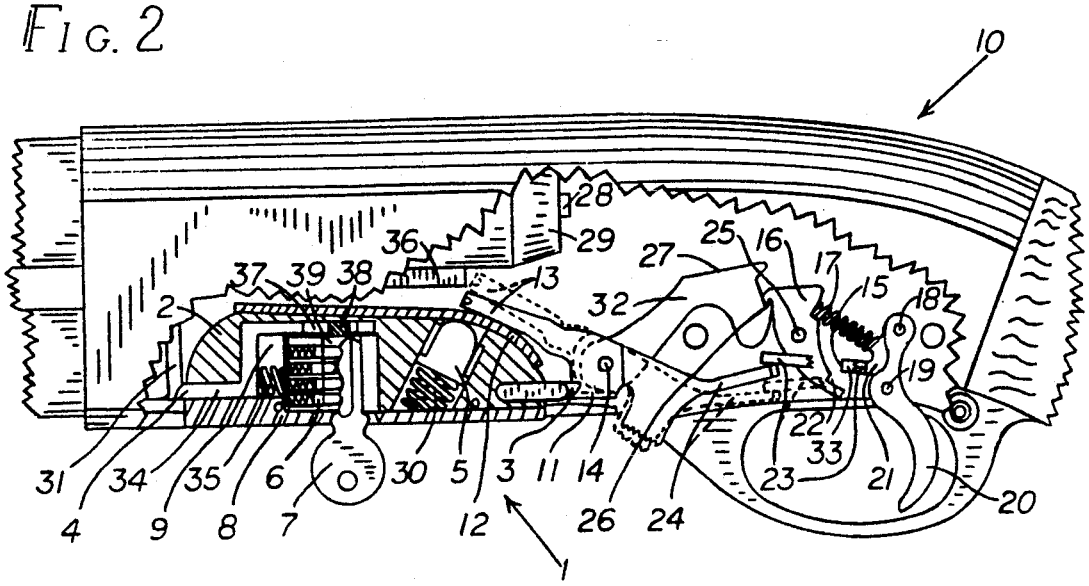
FIG. 2 is a fragmentary, partly cross-sectional view of the safety locking device of FIG. 1 and secured in a tubular magazine shot gun.

The first embodiment of the invention, shown in FIGS. 1 and 2 is utilizes a REMINGTON (Registered Trade Mark) pump action shot gun model 870.

The safety locking device comprises a block-form body 2 having a bipartite cavity 9 opening to a lower face and containing in one part thereof a lock element 6 which controls a spring loaded latch 4 and, in the second part, a spring loaded ejection button 5 and a bottom retaining plate 8 covering the cavity opening thereby maintaining the above-mentioned parts therein. The retaining cover plate 8 is secured to the body by sliding engagement of depending lands and grooves formed on respective opposite sides of the body and base, respectively, and receipt of transverse locking pins in aligned bores extended transversely through the groove side walls and lands. A short tailpiece 3 is immovably fixed to the body to project from the rear end thereof. A key 7 is provided for actuation of the lock element 6 by rotation through 90°, thereby withdrawing latch within the body to unlock the device.

As will be understood by those familiar with pump action shot guns of the above-mentioned type, in the absence of safety locking device 1, to initiate the normal firing sequence, a shell is placed in the firing chamber of the barrel, or fed from the tubular magazine 31, and breechblock 29 closed. Squeezing trigger 20 causes the trigger to rotate on pivot 19, compressing trigger spring 17 and forcing pivot 18 forward. A connector 21 is rotatably attached to pivot 18 has a pair of fixed arms extending towards the front that define the shape of a horizontal U or wishbone. The innermost, shorter arm 33 has a sear contact nose 15 formed on a front end. The outer, longer arm 23 (shown cut-away) is engaged by a rear arm 24 of action bar lock 13 which, in the absence of the locking device 1, is free to be rotated clockwise on a pivot 14 by a biasing spring (not shown)to the position shown in broken lines, enabling the rear arm 24 to permit the trigger biasing spring 17 to position the long arm 23 (broken lines) and, therefore, the short arm 33 at their lowest levels, placing the sear contact nose 15 of the short arm 33 in direct alignment with notch 22 of sear 16 for engagement therewith to transmit the force applied to the trigger 20 directly to the sear 16, rotating the sear clockwise on pivot 25 causing it to disengage from hooking engagement 26 with the hammer 32, thereby freeing the hammer to be rotated counter clockwise on pivot 14, by the action of its expanding mainspring (not shown) until the hammer face 27 impacts on firing pin 28 of breechblock 29, discharging the piece.

Safety locking device 1 is installed in the bottom loading port of the firearm 10 by engaging the rear end of the body 2 on a rear edge of the loading port and pivoting the body upwardly until the chamfered nose of latch 4 is depressed by engagement with the front edge of the loading port, with resilient flexure of biasing spring 35, and is snapped into place in the receiver behind the rear bottom wall of tubular magazine 31 by the resiling action of the biasing spring.

During insertion of the safety locking device the following four actions occur:

(1) During the pivotal movement of the body 2 into the magazine, the tail piece 3 engages a U or channel section 11 of action bar lock 13 located forwardly of the pivot 14, rotating the action bar lock 13 counter clockwise to the position shown in solid lines thereby raising rear arm 24 which engages and lifts long arm 23 (from the position shown in broken lines) and therefore short arm 33 of connector 21, lifting the sear contact nose 15 thereof out of the contact travel path with sear notch 22, thereby preventing any force from the trigger from being transmitted to the sear 16, which prevents release of hammer 32.

(2) Extraction button 5 is forced downwardly into the cavity well by engagement with the bottom of shell carrier 12, compressing the biasing spring 30. The compressed spring provides a desirable ejection force when the latch is unlocked facilitating removal of the safety locking device from the magazine.

(3) A top side of body 2 pushes the shell carrier 12 to the uppermost position where it blocks the normal motion of slide 36, thereby locking breechblock 29 in closed position so that it cannot be opened and a shell cannot enter the breech.

(4) The latch 4 of the connector 34 is cammed rearwardly by the engagement of the tip with the front edge of the magazine well wall depressing latch biasing spring 35 so that the stored spring force causes the latch to snap into position behind the bottom rear end wall of tubular magazine 31 adjacent the loading port, thereby locking the body in the magazine with the cover plate 8, completely closing the loading port and following the contour of and flush with the outer surface of the receiver the firearm.

Thus, the firearm 10 is secured against unauthorized loading and firing, safe for storing in the home with children present even though the firearm may have been inadvertently left in loaded condition at the time the safety locking device 1 was installed.

It will be readily understood that the firearm 10 may be restored to its normal working condition by inserting key 7 in the pin tumbler lock element 6 and turning through 90°. This action rotates lock cylinder 39 turning a tongue 38 affixed at the upper end of the lock cylinder in a square hole 37 at the rear of connector 34 thereby camming the connector 34 rearwardly, compressing biasing spring 35 and withdrawing latch 4. The instant that latch 4 is withdrawn clear of the rim of the loading port, the ejection button 5 will rise in the well, propelled by the biasing spring 30, and push against the shell carrier expelling the safety locking device from the firearm.

The second embodiment, shown in FIGS. 3–6, differs from the first embodiment substantially only in the latching mechanism.

Figure 3A:
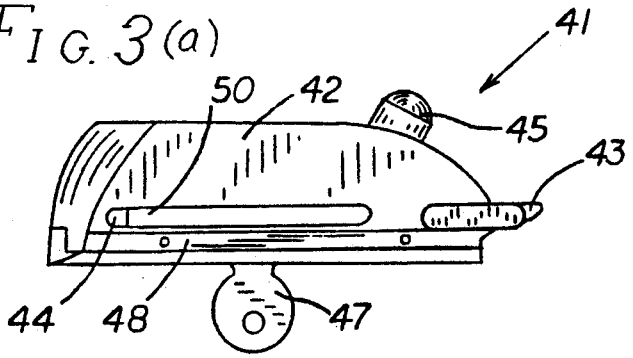
FIGS. 3(*a*)–3(*c*), respectively, are side elevational, rear elevational and underplan views of a second embodiment of safety locking device according to the invention.
Figure 3B:
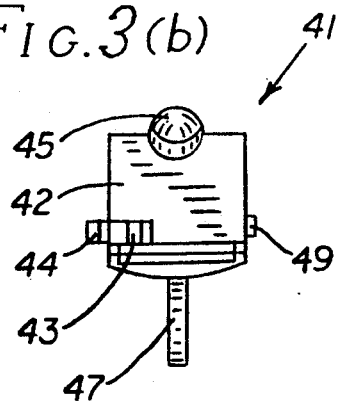
Figure 3C:
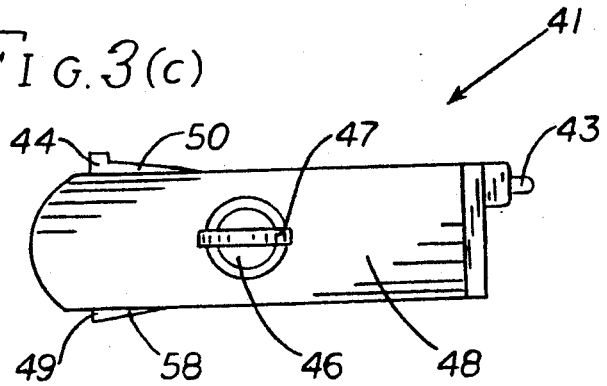
Figure 4:
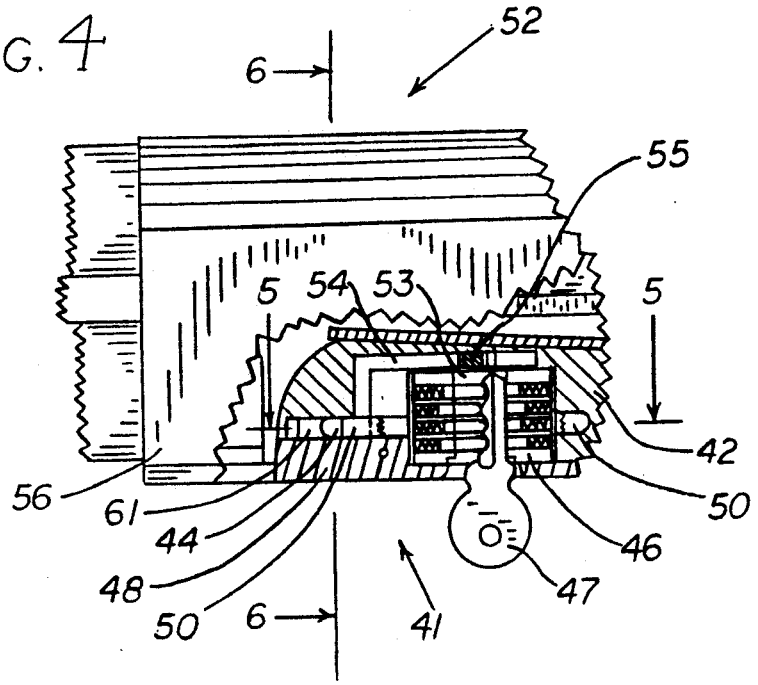
FIG. 4 is a fragmentary view, partly in cross-section, of the safety locking device of FIG. 3, installed in a similar firearm to that of FIG. 2.

As shown particularly in FIG. 3, the safety loading device 41 comprises a block form body 42 formed with an internal cavity closed at a lower face by a cover plate 48 and containing a lock element 46 which controls the operation of latching lugs 44 and 49. The lugs are carried at the outer extremities of cantilever spring arms 50 and 58, affixed at opposite ends by pins 62 to extend in slots formed in respective sides of the body 42. A tail piece 43 extends from the rear of the body and spring loaded ejection button 45 protrudes from the top of the body. The tail piece 43 and the ejector button 45 are identical both in structure and function to those of the previous embodiment.

A removable key 47 operates lock element 46 by rotation through 180° thereby causing lugs 44 and 49 to protrude beyond the sides of body 42, lug 44 being provided with an outwardly extending rectangular heel so that it protrudes further from the side of the body than lug 49.

Figure 5:
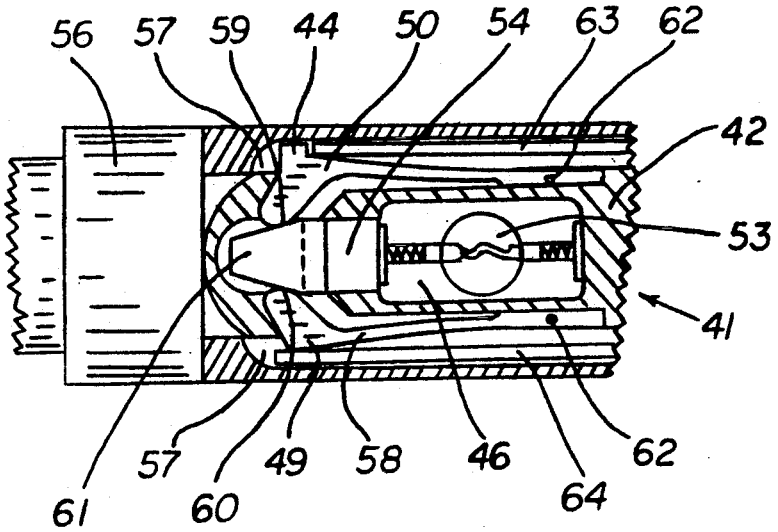
FIG. 5 is a fragmentary view, partly in cross-section taken along 5—5 of FIG. 4.
Figure 6:
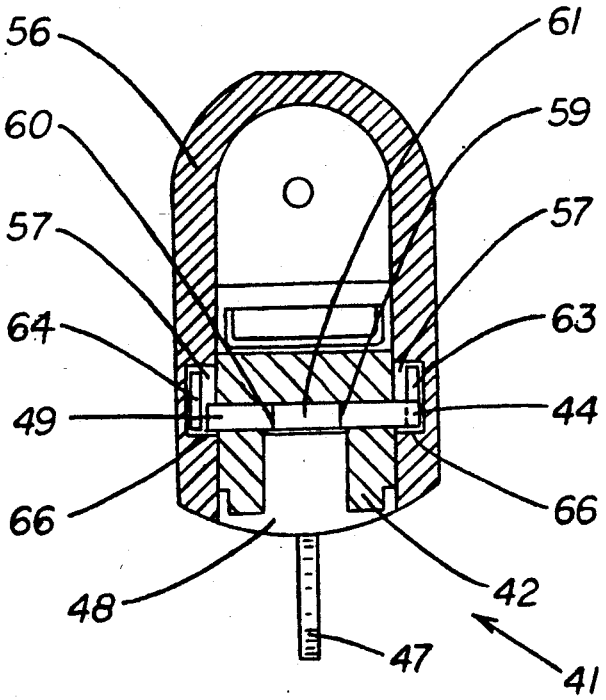
FIG. 6 is a cross-sectional view taken on line 6—6 of FIG. 4.
Figure 7A:
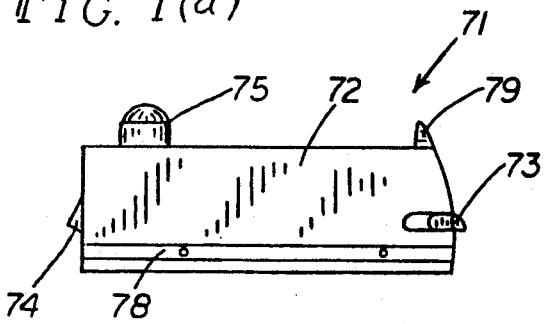
FIGS. 7(*a*)–7(*c*) are, respectively, side elevational, rear elevational and underplan views of a third embodiment of the invention.
Figure 7B:
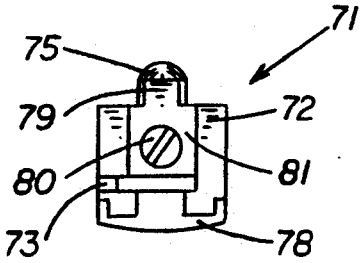
Figure 7C:
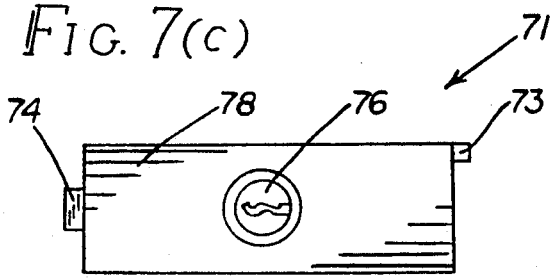
Figure 7D:
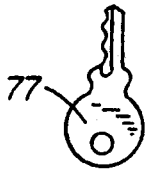

Prior to installation of the safety locking device in the loading port of receiver 56 of firearm 52, the safety device must firstly be placed in the unactuated condition, that is with lugs 44 and 49 withdrawn within the profile of the sides of body 42. The rear end of the body is then engaged in the rear edge of the loading port and the body pivoted upwardly into the magazine until it abuts against the shell carrier in the uppermost position and is manually retained therein until key 47 is turned through 180°. An eccentric pin 55 is fixed on the top of lock cylinder 53 (FIG. 4) and engages in a transverse slot formed in the rear end of connector 54 so that actuation of the pin tumbler lock element 46 by the rotation of the key 47 causes the rotation of lock cylinder 53 to turn the eccentric pin 55 in the slot advancing a camming nose 61 progressively between inwardly extending cam following lug portions 59 and 60, camming the lugs apart into a pair of grooves 57 preformed in respective opposite side walls of the receiver 56 (FIG. 5 and FIG. 6). The cantilever spring levers 50 and 58 are anchored at their rear ends in slots formed in respective opposite sides of the body by pins 62. The grooves 57 contain left and right shell latch springs 63 and 64, the left spring 63 being shorter than the right spring 64 to leave space to accommodate entry of the heel of lug 44 into the groove. The shell latch springs occupy the mouths of the grooves when in unstressed condition and therefore are flexed into the grooves by the entry of the latching lugs 44 and 49 and provide an additional biasing force urging the lugs out of the grooves when the locking element is unlocked.

In the fully locked condition, lugs 44 and 49 abut lower shoulders 66 of the grooves (FIG. 6) with the heel extension of lug 44 received in front of shell latch spring 63, fully anchoring the safety device in the receiver 56, from which it cannot be removed, even by disassembly of the firearm 52.

The firearm 52 is therefore completely secure against unauthorized use, meeting the requirements of maximum security such as required by the open storage of firearms in a military facility.

This embodiment provides greater security than the device of FIG. 1 but is less easy to install and is of increased mechanical complexity.

Figure 8:
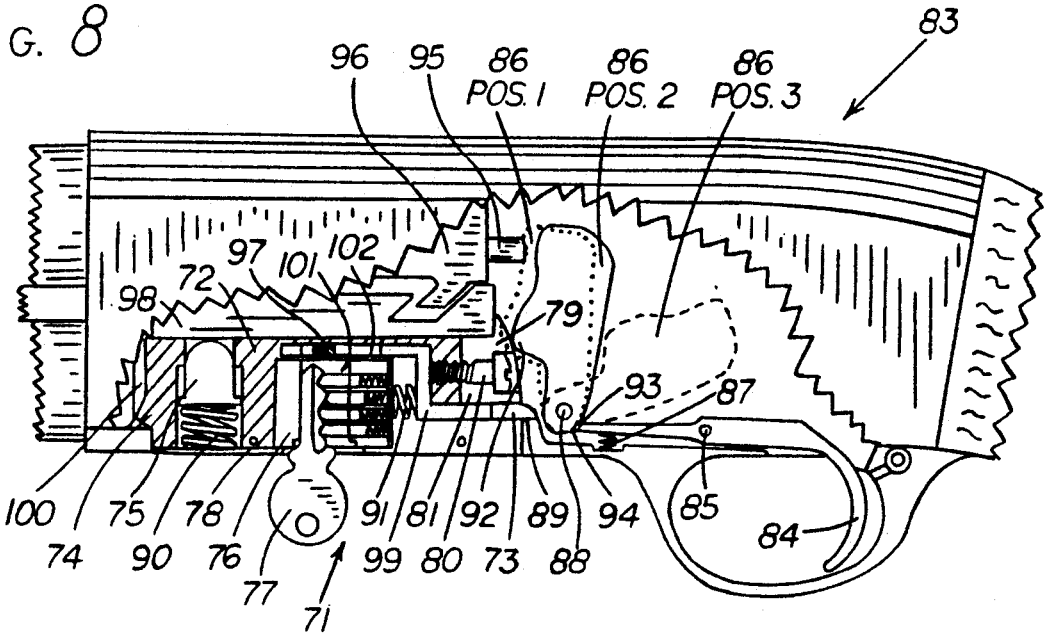
FIG. 8 is a fragmentary view, partly in cross-section of the safety locking device of FIG. 7, installed in a different model of tubular magazine shot gun.

The third embodiment of safety locking device shown in FIGS. 7 and 8 utilized in an ITHACA (Reg. Trade Mark) pump action shotgun Mod. 37, comprises a block form body 72 having an internal cavity containing a lock element 76 which controls spring loaded latch 73, ejection button 75, insert block 81, secured in a clevis in the rear of body 72 by screw 80 and having a fixed vertical projection 79 on a top thereof, and cover plate 78, closing the cavity, confining the parts therein. A lug 74 is formed at the front end of body 72 and a key 77 is provided for actuation of the lock element 76 by rotation through 90° to effect withdrawal of latch 73 within body 72.

Normally, in the absence of the safety locking device 71, the shotgun is fired by placing a shell in the chamber of the barrel or feeding the shell from the tubular magazine 100 and closing the breechblock 96. Squeezing trigger 84 rotates the trigger on pivot 85 compressing trigger spring 87 and disengaging a sear nose 93 formed at the forward end of the trigger member by downward counter-clockwise movement, from sear notch 94 of hammer 86 then in the cocked position 3 shown in broken lines. The hammer 86 then falls, rotating on pivot 88 under the action of the main spring, (not shown), impacting on firing pin 95 of breechblock 96, when in the position 1, shown in dotted line, and discharges the piece.

The safety locking device 71 is installed in the loading port by engaging lug 74 with the rear bottom wall of tubular magazine 100 and pivoting the device upwardly until latch 73 overrides the rim of the trigger guard under the action of the canning nose, and snaps into place inside the trigger guard recess 89.

The installation may be carried out with either the hammer 86 in the down position 1 or in the cocked position 3.

In the former position, the projection 79 of the insert block 81 will engage hammer protrusion on 92 and cam hammer 86 rearwardly rotating on pivot 88 until the hammer assumes the position 2 shown in a solid outline, thereby retaining the hammer spaced by a short distance out of contact with firing pin 95. In this position, the hammer cannot be actuated by the trigger 84.

If the hammer 86 is in the cocked position 3 during insertion of the safety locking unit, the hammer will remain cocked and protrusion 79 will again assume the position shown in FIG. 8. Clearly, if the trigger were pulled, movement of the hammer would be arrested by impact of hammer protrusion 92 protrusion 79 of the safety locking device when the hammer would again assume position 2, spaced apart from the firing pin 95, preventing discharge of the piece.

As with the previous embodiment, the insertion of the safety locking device 71 into the firearm 83 causes button 75 to be depressed in its well, compressing spring 90. On insertion protrusion 79 is positioned behind slide 98, preventing rearward movement thereof, blocking the breechblock 96 so that the breech cannot be opened.

Thus, the gun has been secured and is unfireable even if the safety locking device 71 was inserted when the gun was loaded and cocked.

To restore the firearm to use, key 77 is inserted in pin tumbler lock element 76 and rotated with lock cylinder 101 through 90° causing tongue 97 fixed to the top of the cylinder lock 101 to turn in the square hole 102 in the front of connector 99 camming it rearwardly, compressing spring 91 and withdrawing latch 73 from engagement in recess 89. At the instant of withdrawal of the latch, the ejection button will rise in its well propelled by the biasing spring 90, expelling the device from the firearm.

I claim:

1. In a tubular magazine firearm of a type comprising a trigger linked to a hammer retraining sear by a connector pivotally mounted for movement by the trigger along a path into operative engagement with the sear, causing the sear to release the hammer, and a rocking action bar having a rocking arm extending away from a loading port into engagement with a side of the connector and pivotal in one direction to carry the connector out of the operational path of engagement with the sear to prevent release of the hammer, a key operated safely locking device comprising:

a body insertable through the loading port so as to be contained substantially completely within a receiver behind the tubular magazine and forming a snug fit with a rim of the loading port;

a key operated locking mechanism contained in the body;

latching means mounted for movement in the body by the locking mechanism between an advanced latching position and a retracted unlatching position, engaging behind the rim of the loading port and withdrawn within a profile of the body, respectively;

an action bar engaging projection extending rearwardly from the body and engageable by receipt of the body in the loading port, with an action bar lock to pivot the action bar in the one direction raising the connector into an inoperative position so that squeezing the trigger cannot effect release of the hammer and the firearm will not fire.

2. In a firearm according to claim 1, including a shell carrier moveable from a lower, loading port covering position to a raised position, spaced above the loading port and a base of the receiver leaving a gap therebetween, a tail piece of the action bar engaging protection is received between the shell carrier and the receiver base, and the safety locking device further includes ejection means comprising a button mounted on a top of the body and depressible into a well formed in the body against an action of a biasing spring, insertion of the body in the loading port causing depression of the button into the body by engagement with the shell carrier so that, on release of a latching mechanism, the restoring force of the biasing spring advances the button from the well, ejecting the safety locking device from the loading port.

3. In a firearm according to claim 1, the safety locking device including spring means within the body biasing the latching means into the advanced latching position, a camming nose formed on the latching means engageable with a forward rim of the loading port on insertion of the body tail first therein, for camming the latching means into the body against an action of the biasing spring, whereby the body is receivable, rear end leading, into the loading port with a snap action.

4. In a firearm according to claim 1, the body of the safety locking device including a block having a cavity therein and a cover plate attachable to the body to close the cavity, trapping the locking means and ejection means therein.

5. In a firearm according to claim 1, interior, opposite walls of the receiver being formed with longitudinally extending grooves and the latching means comprising a pair of latching lands carried by respective cantilever spring arms, the body of the safety locking device being formed with a slot and the cantilever spring arms being mounted in the slot biasing the lands towards each other so as to be contained entirely within the block, in an unlocked condition and an operating member having a tapered, camming nose located between the lands and operably connected to the locking mechanism for movement of the operating member between an advanced locking position and a retracted release position, corresponding to the advanced latching position and retracted unlatching position of the latching means, respectively, camming the respective lands apart into the grooves and permitting the respective lands to resile back into the body, respectively.

6. In a tubular magazine firearm of a type having a loading port, and a hammer pivotally mounted for firing movement towards the loading port, and into engagement with a firing pin in a breechblock over a slide, a trigger integrally jointed to a hammer engaging sear so that pulling the trigger disengages the sear from restraining engagement with the hammer to release the hammer, a key operated safety locking device comprising:

a body insertable through the loading port so as to be contained substantially completely within a receiver behind the tubular magazine and forming a snug fit with a rim of the loading port;

a key operated locking mechanism contained in the body;

latching means mounted for movement in the body by the locking mechanism between an advanced latching position and a retracted unlatching position, engaging behind the rim of the loading port and withdrawn within a profile of the body, respectively; and, blocking means mounted on a rear of the body for engagement with the hammer maintaining the hammer spaced from the firing pin.

7. In a firearm according to claim 6, the hammer blocking means including an upstanding projection for engagement behind the slide, thereby locking the slide and the breechblock in place, preventing opening of the breech.

* * * * *